United States Patent [19]

Chiang-Cheng et al.

[11] 4,207,965

[45] Jun. 17, 1980

[54] GLIDING CARS AND TRACKS TYPE HIGH BUILDING EMERGENCY ESCAPING DEVICE

[76] Inventors: Fu Chiang-Cheng, P.O. Box 144; Yang Yin-Lung, P.O. Box 865, both of Kaohsiung, Taiwan, 800

[21] Appl. No.: 842,271

[22] Filed: Oct. 3, 1977

Related U.S. Application Data

[63] Continuation of Ser. No. 680,747, Apr. 27, 1976, abandoned.

[51] Int. Cl.[2] ..... A62B 1/02

[52] U.S. Cl. ..... 182/13; 182/3; 182/36; 182/19; 182/48

[58] Field of Search ..... 182/48, 49, 12, 13, 182/36, 3, 5, 6, 7; 193/27, 28, 32

[56] References Cited

U.S. PATENT DOCUMENTS

| | | | |
|---|---|---|---|
| 802,252 | 10/1905 | Anderson | 182/3 |
| 1,494,696 | 5/1924 | Maclaren | 193/32 |
| 3,944,021 | 3/1976 | Smith | 182/3 |

*Primary Examiner*—Reinaldo P. Machado

[57] ABSTRACT

An emergency escaping device of this invention consists of a continuous W shape metallic tracks vertically mounted alongside the outer wall of a building or between buildings. Said tracks having their interval branches of inlet tracks adjoining to the exit of each floor of the building or buildings and, a number of loader cars for carrying persons or properties from all floors to glide down along the same tracks. Said tracks equipped with automatic sequence controls thereon to keep said loader cars one by one safely gliding onto the ground in case of emergency. The tracks can be made in rolls of flexible material and the cars can be made of jacket style for individual personnel to escape from windows if there is no metallic tracks installation.

3 Claims, 9 Drawing Figures

GLIDING CARS AND TRACKS TYPE HIGH BUILDING EMERGENCY ESCAPING DEVICE

This application is a continuation of Ser. No. 680,747, Apr. 27, 1976, abandoned.

An object of this invention is in relative simplicity of construction and operation of the system which enable it to efficiently expedite the rescue of large numbers of people or properties while requiring a minimum of system maintenance and the cost of manufacturing.

Other object of this invention is to provide means for people of young or old, strong or weak who can ride on as easy and safe as on a bus to escape.

Another object of this invention is to provide an automatic sequence control to keep the escaping persons one by one gliding down from different floors without stacking or difficulty.

Still another object of this invention is to provide an equipment for exercise or for fun in the play ground.

Other objects and advantage will become apparent from the following description taken in connection with the accompanying drawings.

In which.

Figure 1:
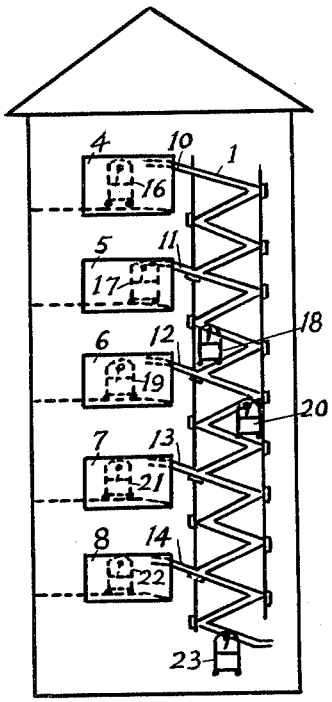
FIG. 1 is a side view of a high building equipped with single row emergency escaping device of the invention.
Figure 2:
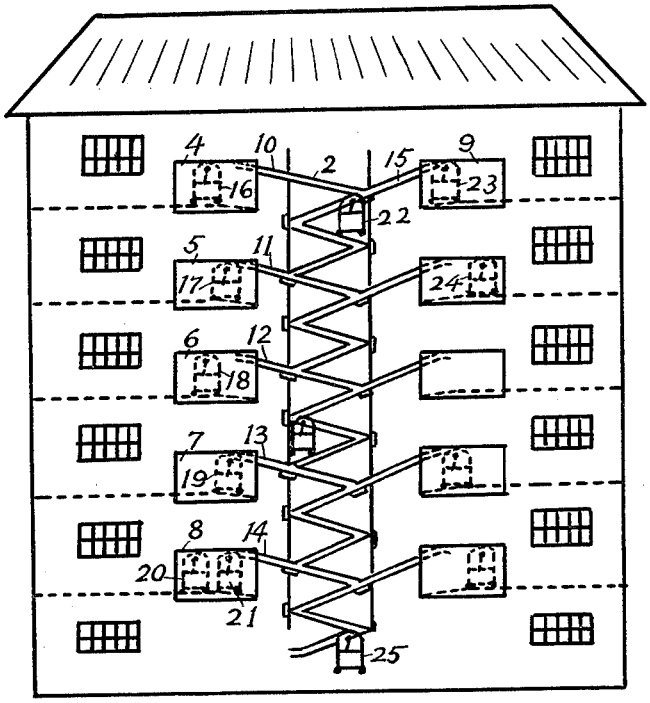
FIG. 2 is a front view of a high building equipped with double rows emergency escaping device of the invention.
Figure 3:
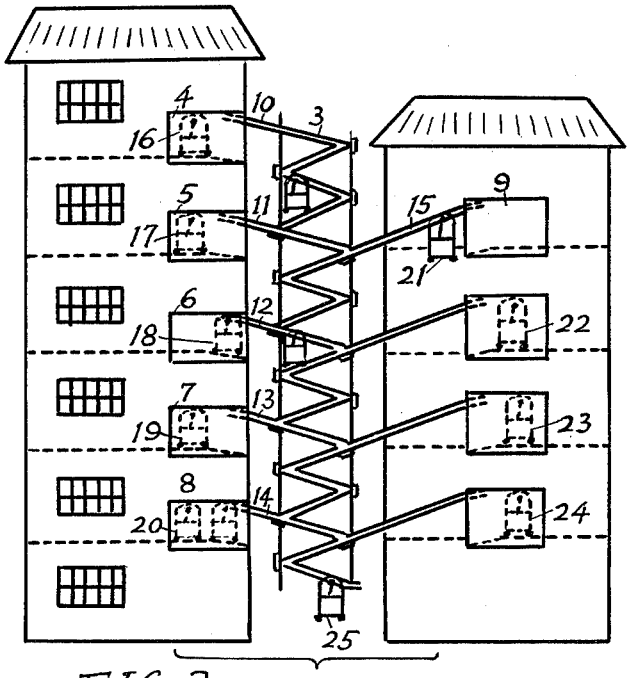
FIG. 3 is a front view of two high buildings equipped with double rows emergency escaping device of the invention.
Figures 5A, 5B:
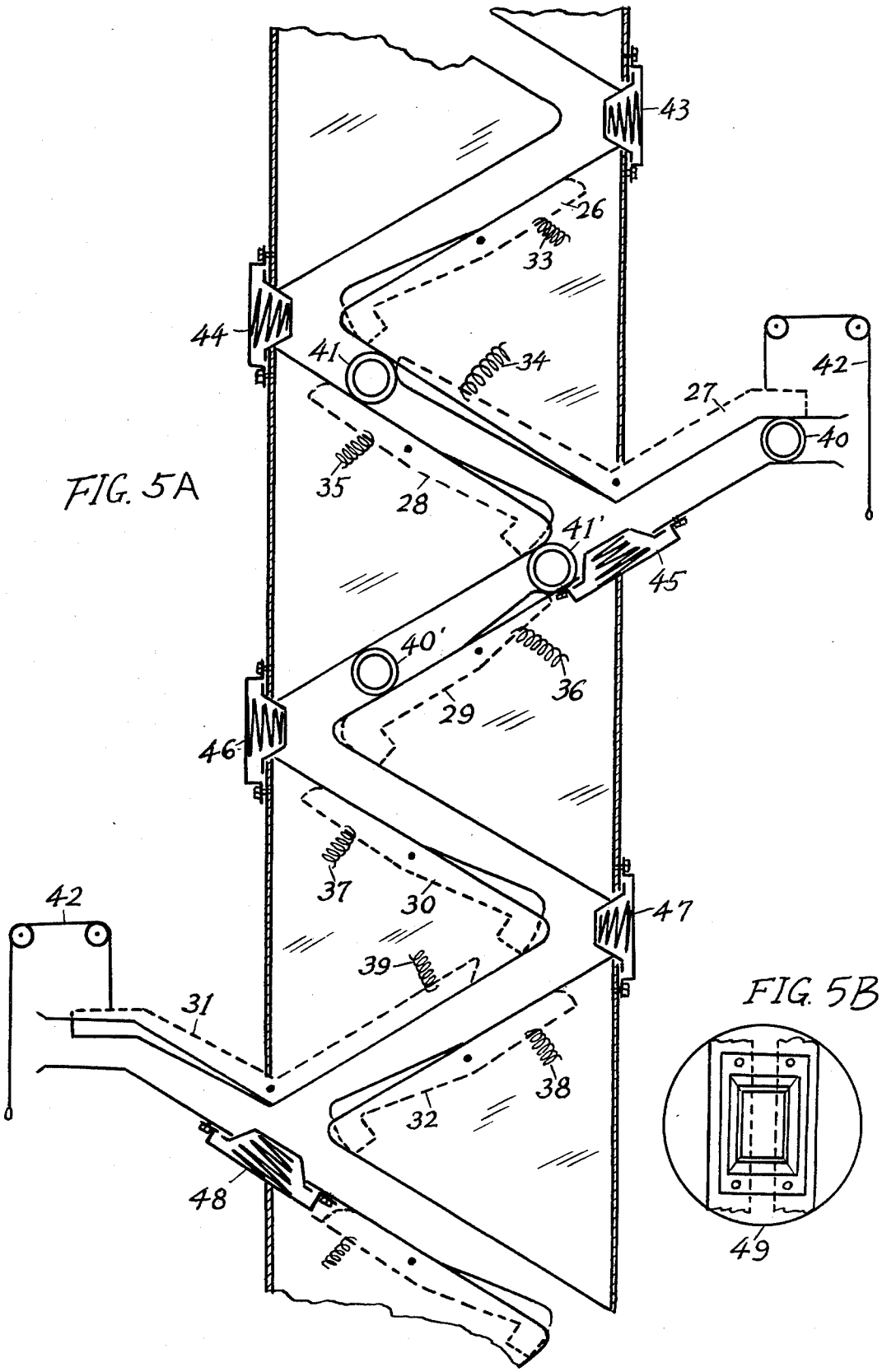
FIG. 5 is a plan view of a portion tracks of the invention showing the automatic sequence controls thereon.
Figure 7:
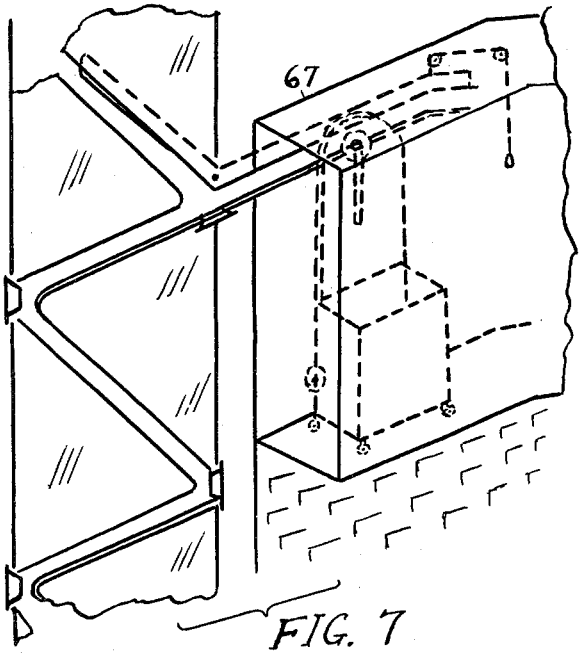
FIG. 7 is a stereo and side perspective view of a loader car riding on the tracks at a tunnel of an exit.
Figure 6:
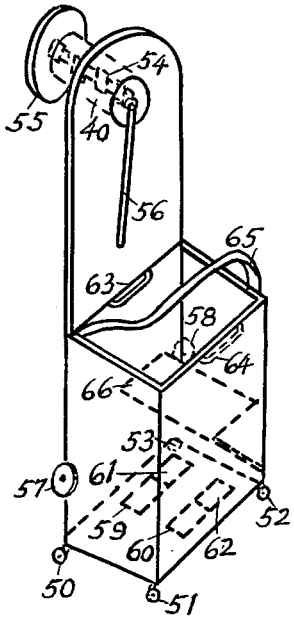
FIG. 6 is a stereographic view of a loader car.

As shown in FIGS. 1, 2 and 3 the metallic tracks 1, 2, 3 are adjoining rigidly with each exit 4, 5, 6, 7, 8, 9 by their branches tracks 10, 11, 12, 13, 14, 15 respectively on the side or front wall of a building, a number of loader cars 16 thru 25 are in their position gliding or ready to glide down from each floor along the same tracks when in emergency, they will glide down one by one because of automatic sequence controls thereby which will be described as follows: There are certain number of retaining bars (see 26 thru 32 in FIG. 5) pivotly mounted between the tracks in such a manner that they are spring loaded (see 35 thru 39 in FIG. 5) respectively to off set one end of the retaining bars in the passage of the tracks. Each loader car is provided with a roller axle (40 in FIG. 6) for travelling and supporting in the tracks. Said retaining bars will pivot (see 27, 29 in FIG. 5) whenever the roller axle of the proceeding car passes by and temporarily blocks the passage of the tracks to retain adjacent following car from gliding down at the same time, therefore automatically control the gliding sequence. Said retaining bars will return to their normal position by said springs tension together with the fractional weight of the following car which is transmitted by roller axles acting at the slope end of the retaining bars when the roller axle of the preceeding car has just passed and released the other end of the retaining bars. The width of the loader car also is one of the factor in governing the sequence of gliding, since two adjacent cars can never come to meet the same retaining bar at the same time because of the width between the center lines of two adjacent cars is greater than the half length of the retainer bar. However, a string or cable with pulleys must be used to lift up the retaining bar at each exit for getting said roller axle of the car onto the tracks (see 42 in FIG. 5) at the beginning. A spring damper is located at each corner of the tracks for dampen the bounsing force of the gliding cars (as shown 42 thru 48 in FIG. 5) said each damper is protruded from an aperture at each corner of the tracks and is covered by a stainless steel cap which is screws fastened on the structure of the tracks (see enlarged drawing 49 in FIG. 5). FIG. 6 shows the structure of one of the loader car, it is in a basket shape with four universal small wheels 50, 51, 52, 53 at the bottom and a ball bearing roller axle 40 firmly mounted at the top of the back side of the car. Said axle is hollowed in its center, a worm screw 54 protrudes all the way thru the hollowed center of said axle and is connected to a lining brake disk 55, said screw 54 can be operated by a rocking lever 56 inside the car to bring the lining disk toward the back side of the car causing clamp action on the tracks (when gliding on the tracks) for stopping or slowing down the gliding speed of the car in case of necessity. Two universal wheels 57, 58 are mounted at both side of the car for counteract the momentum of the car against the surface of the tracks and add free gliding moveabitity of the gliding car. There are two parallel apertures 59, 60 on the floor of the car normally covered by couple of light spring loaded slider plates 61, 62. People can stretch his feet thru the apertures when he gets in the car and runs together with the car by his own feet while his hands hold on a pair of grips 63, 64 thereby or to tight up a safety belt 65 on his shoulder. However, for children or old and weak person who just sits on the seat 66 without stretching his feet from said apertures, then the car can be pushed on the wheels 50, 51, 52, 53 by other person until the car properly get in exit tunnel 67 of the device (see FIG. 7). The size of the exit tunnel should be made about the size of the car and will let the car get in one proper direction only to assure the said roller axle get on the tracks at proper position for safety.

Figure 4:
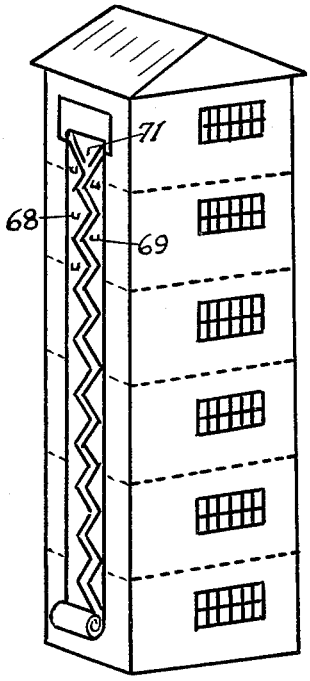
FIG. 4 is a side view of a roll of flexible tracks hung down from the window of a building for individule personnel when there is no metallic tracks installation.
Figure 9:
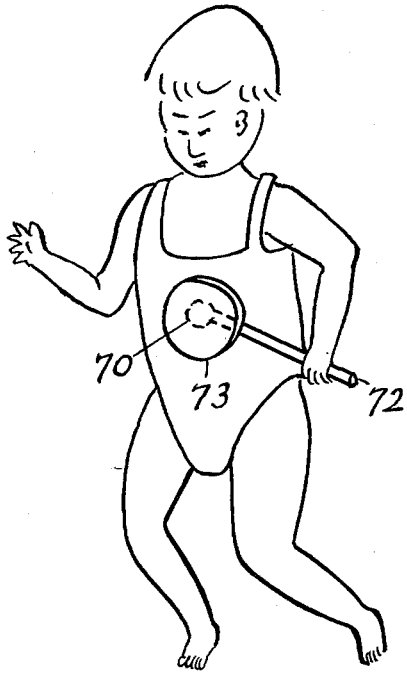
FIG. 9 is a stereo-graphic view of the gliding jacket put on a person.
Figure 8:
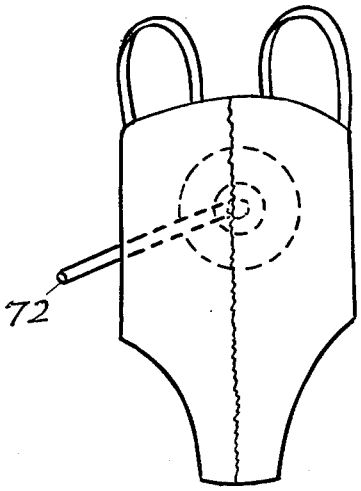
FIG. 8 is a rear view of a gliding jacket for individule personnel.

FIGS. 8, 9 and 4 show a gliding jacket and a flexible tracks for individule personnel when there is no metallic tracks installation. Said flexible tracks may be hung on the window and the person who put on the jacket can climb out of the window (with facing the window) on the steps 68, 69—then fits the roller axle 70 of the jacket into the opening of tracks 71 to glide down along the tracks. A rocking lever 72 is used for control a lining brake disk 73 which is similar to the aforesaid brake disk on the loader cars.

What we claim is:

1. An improved apparatus for emergency escape from a conventional zigzag tracks type emergency escape device comprising a number of loader cars in basket shape, each car having a ball bearing roller on an axle at the top back side of the car for supporting and sliding along the tracks, said axle is hollowed in its center, a worm screw protruds all the way through the hollowed center of said axle and connected to a lining brake disk, said screw is operatable by a rocking lever inside the car to bring said lining disk toward the back side of the car and clamps the track for stopping or slowing down the sliding speed of the car in case of necessity, two universal wheels being mounted at both rear side edges of the car for counteracting the momentum of the car against the surface of the tracks and add free sliding movability of the car, four universal small wheels located at the bottom of each car, the car while carrying escapee or properties can be pushed on said wheels by other person until the car properly gets in an exit tunnel which is communicating with the tracks, two paralled apertures on the floor of the car normally covered by couple of light spring loaded slider plates for stretching the rider's feet on running in case of necessity.

2. The apparatus of claim 1, in which a certain number of special contoured retaining bars pivotaly mounted between the tracks in such a manner that each bar is spring loaded to off set one end of the retaining bar in the passage of the track, said retaining bar will pivot whenever the roller on the axle of the preceeding cars pass by the contour of the retaining bar and temporarily blocks the passage of the tracks to retain the adjacent following cars from sliding down at the same time, therefore automatically control the sliding sequence, said retaining bars can be operated to off set their ends by conventional solenoids of electrical timing system in lieu of the said springs, a string is provided and attached to one end of the retaining bar at each exit of the tunnel for getting said roller on the axle of the car onto the track at the beginning.

3. The apparatus of claim 1, in which said tracks can be made in roll of flexible suitable material and said cars can be made in jacket style with similar facilities for individual personnel when there is no metallic tracks installation available.

* * * * *